US012144386B2

(12) United States Patent
Larson et al.

(10) Patent No.: US 12,144,386 B2
(45) Date of Patent: Nov. 19, 2024

(54) IMPACT ABSORBING PAD FOR GARMENT

(71) Applicant: Dick's Sporting Goods, Inc., Coraopolis, PA (US)

(72) Inventors: Charles P. Larson, Coraopolis, PA (US); Shing Jiu Sheu, New Taipei (TW)

(73) Assignee: DICK'S SPORTING GOODS, INC., Coraopolis, PA (US)

( * ) Notice: Subject to any disclaimer, the term of this patent is extended or adjusted under 35 U.S.C. 154(b) by 0 days.

(21) Appl. No.: 18/126,219

(22) Filed: Mar. 24, 2023

(65) Prior Publication Data

US 2023/0232915 A1 Jul. 27, 2023

Related U.S. Application Data

(62) Division of application No. 16/560,032, filed on Sep. 4, 2019, now abandoned.

(51) Int. Cl.
*A41D 13/015* (2006.01)

(52) U.S. Cl.
CPC ..... *A41D 13/0158* (2013.01); *A41D 13/0153* (2013.01); *A41D 13/0156* (2013.01)

(58) Field of Classification Search
None
See application file for complete search history.

(56) References Cited

U.S. PATENT DOCUMENTS 1,685,825 A 10/1928 Mullins
1,910,810 A 5/1933 Nash
2,266,886 A 12/1941 McCoy
(Continued)

FOREIGN PATENT DOCUMENTS

CN 204181024 U 3/2015
CN 108778023 A 11/2018
(Continued)

OTHER PUBLICATIONS

Totally Seals, "What is 'Shore' hardness?"; May 9, 2019 https://www.totallyseals.com/blogs/news/what-is-shore-hardness (2019).
(Continued)

*Primary Examiner* — Jocelyn Bravo
(74) *Attorney, Agent, or Firm* — Foley & Lardner LLP

(57) ABSTRACT

An impact absorbing pad includes a first layer and a second layer. The first layer has a first body-facing surface configured to be positioned adjacent a garment and a first outer surface opposite the first body-facing surface. The first layer comprises a first foam having a first density. The first layer defines a first plurality of voids that extend through the first layer at a first plurality of positions. The second layer has a second body-facing surface positioned adjacent the first outer surface of the first layer and a second outer surface opposite the second body-facing surface. The second layer comprises a second foam having a second density that is different than the first density. The second layer defines a second plurality of voids that extend through the second layer at a second plurality of positions. Portions of the first outer surface of the first layer are visible through the second plurality of voids of the second layer.

17 Claims, 8 Drawing Sheets

(56) References Cited

U.S. PATENT DOCUMENTS 2,751,609 A 6/1956 Fred et al.
2,785,739 A 3/1957 McGregor, Jr. et al.
3,012,926 A 12/1961 Wintermute et al.
3,137,746 A 6/1964 Seymour et al.
3,233,885 A 2/1966 Propst
3,285,768 A 11/1966 Habib
3,441,638 A 4/1969 Patchell et al.
3,471,865 A 10/1969 Molitoris
4,136,222 A 1/1979 Jonnes
4,276,341 A 6/1981 Tanaka
4,756,026 A 7/1988 Pierce
5,023,128 A 6/1991 Fatool
5,042,318 A 8/1991 Franz
5,160,785 A 11/1992 Davidson, Jr.
5,446,927 A * 9/1995 Weldon ..... A41D 27/28 2/243.1
5,551,082 A 9/1996 Stewart et al.
5,601,895 A 2/1997 Cunningham
5,689,836 A 11/1997 Fee et al.
5,692,935 A 12/1997 Smith
5,720,714 A 2/1998 Penrose
5,738,925 A 4/1998 Chaput
5,780,147 A 7/1998 Sugahara et al.
D420,786 S 2/2000 Ramer et al.
6,093,468 A * 7/2000 Toms ..... A41D 31/14 2/22
6,584,616 B2 7/2003 Godshaw et al.
6,654,960 B2 12/2003 Cho
6,969,548 B1 11/2005 Goldfine
7,100,216 B2 9/2006 Matechen et al.
7,168,104 B2 1/2007 Tobergte
7,669,251 B2 * 3/2010 Hammons ..... B29C 66/436 2/161.1
8,561,214 B2 10/2013 Turner
8,683,618 B2 4/2014 Grogro et al.
8,764,931 B2 7/2014 Turner
8,931,119 B2 1/2015 Gordon et al.
9,370,215 B1 6/2016 Straus et al.
9,521,870 B2 12/2016 Turner
10,034,498 B2 7/2018 Turner
10,414,921 B1 9/2019 Dehni
10,455,884 B2 10/2019 Wiart et al.
11,432,598 B1 * 9/2022 Grell ..... A63B 71/0054
2003/0204897 A1 11/2003 Cutler
2004/0078860 A1 4/2004 Bell et al.
2004/0171321 A1 9/2004 Plant
2005/0081277 A1 4/2005 Matechen et al.
2005/0137038 A1 6/2005 Vito et al.
2005/0144698 A1 7/2005 Vito et al.
2005/0161982 A1 7/2005 Cormier et al.
2005/0170221 A1 8/2005 Kim et al.
2006/0199456 A1 9/2006 Taylor
2006/0206977 A1 * 9/2006 Hammons ..... B60N 2/522 2/16
2007/0204374 A1 9/2007 Bier et al.
2008/0086916 A1 4/2008 Ellis
2008/0113143 A1 5/2008 Taylor
2008/0166524 A1 7/2008 Skaja et al.
2008/0222766 A1 * 9/2008 Arensdorf ..... A63B 71/08 2/22
2010/0129573 A1 5/2010 Kim
2010/0154106 A1 6/2010 Hammons et al.
2010/0272969 A1 10/2010 Taylor
2010/0312219 A1 12/2010 Wood et al.
2010/0319097 A1 12/2010 Turner
2011/0035864 A1 2/2011 Gordon et al.
2011/0056004 A1 3/2011 Landi
2011/0061154 A1 3/2011 Turner et al.
2011/0189444 A1 8/2011 Beers
2011/0277226 A1 11/2011 Turner
2012/0131720 A1 5/2012 Nordstrom et al.
2012/0142239 A1 6/2012 Budden et al.
2012/0164377 A1 6/2012 Lin
2012/0174282 A1 7/2012 Newton et al.
2013/0025036 A1 1/2013 Turner
2013/0025037 A1 1/2013 Turner
2013/0160179 A1 6/2013 Shiue
2013/0312152 A1 11/2013 Paul et al.
2014/0059734 A1 3/2014 Toronjo
2014/0173815 A1 6/2014 Grogro
2014/0259333 A1 9/2014 Marquez et al.
2014/0304896 A1 10/2014 Nordstrom et al.
2014/0373257 A1 12/2014 Turner et al.
2014/0373259 A1 12/2014 Bergeron
2016/0135528 A1 * 5/2016 Baschak ..... A41C 3/12 2/244
2016/0219979 A1 8/2016 Wright
2016/0327113 A1 11/2016 Shelley
2016/0377139 A1 12/2016 Vito
2017/0028669 A1 2/2017 Regester et al.
2017/0042284 A1 2/2017 Lawless
2017/0164677 A1 6/2017 Olivares Velasco
2017/0182732 A1 6/2017 Toronjo
2017/0238648 A1 8/2017 Farris
2017/0273386 A1 9/2017 Kuo et al.
2018/0132547 A1 5/2018 Vito et al.
2019/0015238 A1 1/2019 Mottram et al.
2019/0075878 A1 3/2019 Abraham
2020/0037680 A1 2/2020 Person et al.
2020/0113255 A1 4/2020 Vescovi
2020/0245710 A1 8/2020 Zhou et al.
2021/0100299 A1 4/2021 Guarnaschelli et al.
2021/0106091 A1 4/2021 Glover et al.

FOREIGN PATENT DOCUMENTS

EP 2 702 884 A1 3/2014
WO WO-2017/147050 A1 8/2017

OTHER PUBLICATIONS

Website Printout for "Nike Free RN 2018 Women's Running Shoes—Island Green/Igloo/Vast Grey" found at: https://www.hockeymonkey.com/nike-footwear-womens-free-m-2018-island-green-igloo-vast-grey.html# printed, Sep. 16, 2020 (2 pages).
Office Action and Search Report on TW 109130183 DTD Nov. 30, 2023, 18 pages including English translations.

* cited by examiner

IMPACT ABSORBING PAD FOR GARMENT

CROSS-REFERENCE TO RELATED PATENT APPLICATION

This application is a divisional of U.S. patent application Ser. No. 16/560,032, filed Sep. 4, 2019, which is incorporated herein by reference in its entirety.

BACKGROUND

Protective clothing can help a wearer (e.g., athlete, soldier, bicyclist, tradesperson, etc.) reduce or prevent impact-related injuries. However, the clothing's structural features that provide this protection often adds bulk and reduces flexibility, which can reduce the wearer's performance during the activity. For example, bulky padding can interfere with an athlete's performance during a sporting event.

This document describes a novel impact absorbing pad, garments containing such pads, and methods of manufacturing such pads that may help address the issues described above.

SUMMARY

In an embodiment, an impact absorbing pad includes a first layer of foam material having a plurality of voids that extend through the layer in a plurality of positions. As an example, in one embodiment, the first layer includes a body-facing surface and an outer surface that is opposite the body-facing surface. A covering covers the outer surface of the first layer, extends beyond at least a portion of the outer surface, and forms a frame around at least a portion of the outer surface. Alternatively, the covering may be attached to the outer surface of the first layer. Optionally, the first layer may exhibit a Shore durometer value between 25 and 50. In another embodiment, the impact absorbing pad may be included in a garment.

Optionally, the voids may include a pattern of shapes, each shape having three void arms of equal lengths and that extend from a central vertex point. As an example, in one embodiment, each void arm may have a distal end and each distal end of each void arm may be equidistant from the distal ends of each closest adjacent void arm in the pattern in which the void is positioned. Alternatively, the distance between the distal end of each void arm may be equidistant from the central vertex point of each adjacent void. In an embodiment, the voids may exhibit equal widths no greater than 10 mm.

Optionally, a second layer of foam material having a plurality of voids that extend through the layer in a plurality of positions may be included adjacent the first layer. As an example, in one embodiment, the second layer includes a body-facing surface and an outer surface that is opposite the body-facing surface. As an example, in an embodiment, the foam material of the first layer may have a first density, the foam material of the second layer may have a second density, and the first density may be different than the second density.

In an alternate embodiment, an impact absorbing pad includes a first layer of foam material having a plurality of voids that extend through the first layer in a plurality of positions and a second layer of foam material having a plurality of voids that extend through the second layer in a plurality of positions. As an example, in one embodiment, the first layer includes a body-facing surface and an outer surface that is opposite the body-facing surface and the second layer includes a body-facing surface that is adjacent to the outer surface of the first layer and an outer surface that is opposite the body-facing surface of the second layer. A covering covers the outer surface of the first layer, extends beyond at least a portion of the outer surface, and forms a frame around at least a portion of the outer surface. As an example, in an embodiment, the foam material of the first layer may have a first density, the foam material of the second layer may have a second density, and the first density may be different than the second density. Optionally, the first foam of the first layer may have a Shore durometer value between 20 and 30, while the second foam of the second layer may have a Shore durometer value between 35 and 45. In another embodiment, the impact absorbing pad may be included in a garment.

Optionally, the voids of the first layer and the voids of the second layer may have a pattern of shapes, each shape having three void arms that extend from a central vertex point. As an example, in one embodiment, each void arm has a distal end and each distal end of each void arm may be equidistant from the distal ends of each closest adjacent void arm in the pattern in which the void is positioned. Alternatively, the distance between the distal end of any void arm in each pattern may be equidistant from the central vertex point of each adjacent void.

Optionally, the positions of voids of the first layer may correspond to the positions of the voids of the second layer. As an example, in one embodiment, the voids of the first layer may exhibit a first size, and the voids of the second layer may exhibit a second size that is larger than the first size so that portions of the outer surface of the first layer are visible through the voids of the second layer. Alternatively, the second size may be smaller than the first size.

Optionally, the outer surface of the first layer may attached to the body-facing surface of the second layer. As an example, in one embodiment, an adhesive may attach the outer surface of the first layer to the body-facing surface of the second layer.

In another alternate embodiment, a garment includes an impact absorbing pad made from a foam material and having a plurality of voids that extend through the impact absorbing pad in a plurality of positions. As an example, in one embodiment, the impact absorbing pad includes a body-facing surface and an outer surface that is opposite the body-facing surface. Optionally, the voids may have a pattern of shapes, each shape having three void arms of equal lengths and that extend from a central vertex point. As an example, in one embodiment, each void arm has a distal end and each distal end of each void arm may be equidistant from the distal ends of each closest adjacent void arm in the pattern in which the void is positioned. Alternatively, the distance between the distal end of any void arm in each pattern may be equidistant from the central vertex point of each adjacent void.

DETAILED DESCRIPTION

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" (or "comprises") means "including (or includes), but not limited to." When used in this document, the term "exemplary" is intended to mean "by way of example" and is not intended to indicate that a particular exemplary item is preferred or required.

In this document, when terms such "first" and "second" are used to modify a noun, such use is simply intended to distinguish one item from another, and is not intended to require a sequential order unless specifically stated. The terms "approximately" and "about" when used in connection with a numeric value, is intended to include values that are close to, but not exactly, the number. For example, in some embodiments, the term "approximately" may include values that are within +/−10 percent of the value.

When used in this document, terms such as "top" and "bottom," "upper" and "lower", or "outer" and "inner," are not intended to have absolute orientations but are instead intended to describe relative positions of various components with respect to each other. For example, a first component may be an "upper" component and a second component may be a "lower" component when a device of which the components are a part is oriented in a first direction. The relative orientations of the components may be reversed, or the components may be on the same plane, if the orientation of the structure that contains the components is changed. The claims are intended to include all orientations of a device containing such components.

Figure 1:
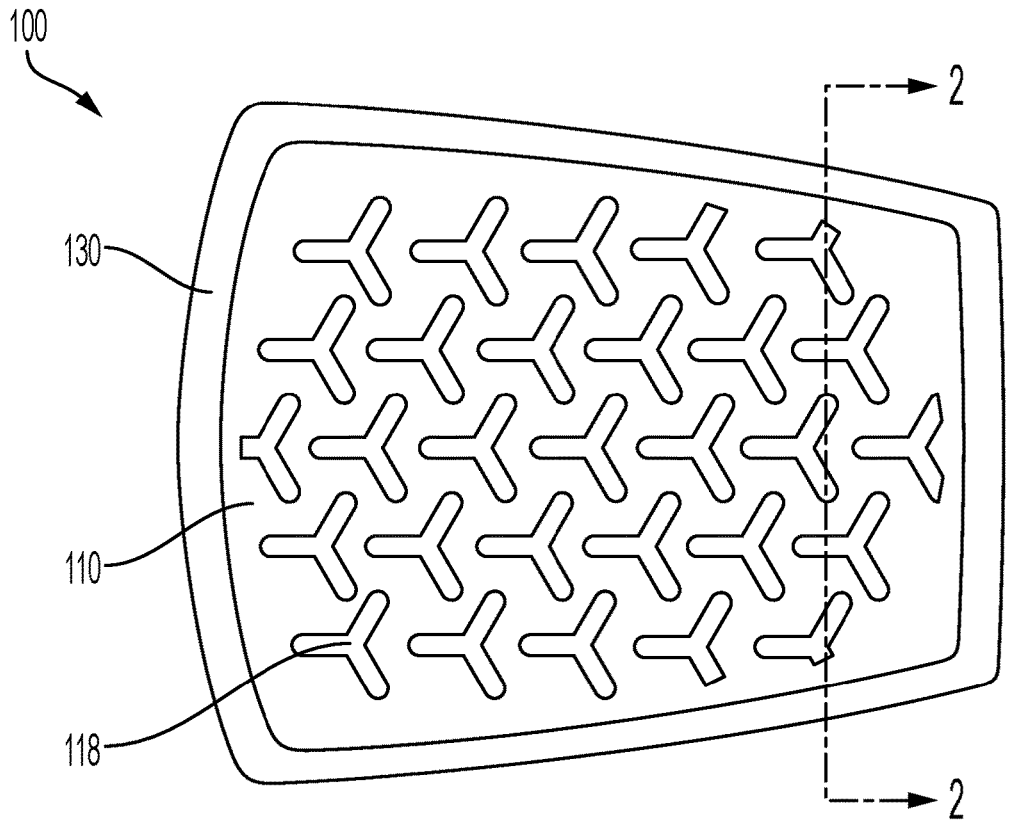
FIG. 1 illustrates a front view of an example pad.

FIG. 1 illustrates a front view of an example impact absorbing pad 100. One or more pads 100 may be placed adjacent a wearer's body to protect the wearer from impacts and prevent impact-related injuries from occurring. For example, a pad 100 may be connected to the interior of protective equipment such as the interior of a helmet, football shoulder pads, or baseball catcher's chest protector. Likewise, the pad 100, for example, may be connected to the exterior of a garment worn by the user, as will be described in more detail below. The connection of the pad 100 to a piece of protective equipment or to a garment may be removable or permanently fixed. For example, one or more pads 100 may be placed in pockets having matching shapes for each pad 100. Likewise, the connection of the pad 100 to the garment may be permanent, such as, for example, by sewing, gluing, heat welding, or the like. A garment having one or more pads 100 (i.e., a padded garment) may be worn by athletes, bicyclists, soldiers, tradespersons, or other users of protective equipment. Examples of padded garments are compression shirts, loose shirts, compression shorts/pants, loose shorts/pants, or the like. Likewise, examples of protective equipment are knee pads, elbow pads, helmets, chest protectors, back protectors, military body armor, or the like.

The impact absorbing pad 100 may have a planar or curved form having one or more layers of impact absorbing material. The pad 100, as shown in FIG. 1, may have a single layer or multiple layers of impact absorbing material (e.g. a first pad layer) 110 and an oversized mesh panel 130 for covering the first pad layer 110 and for attaching to a fabric portion of a garment.

Figure 2:
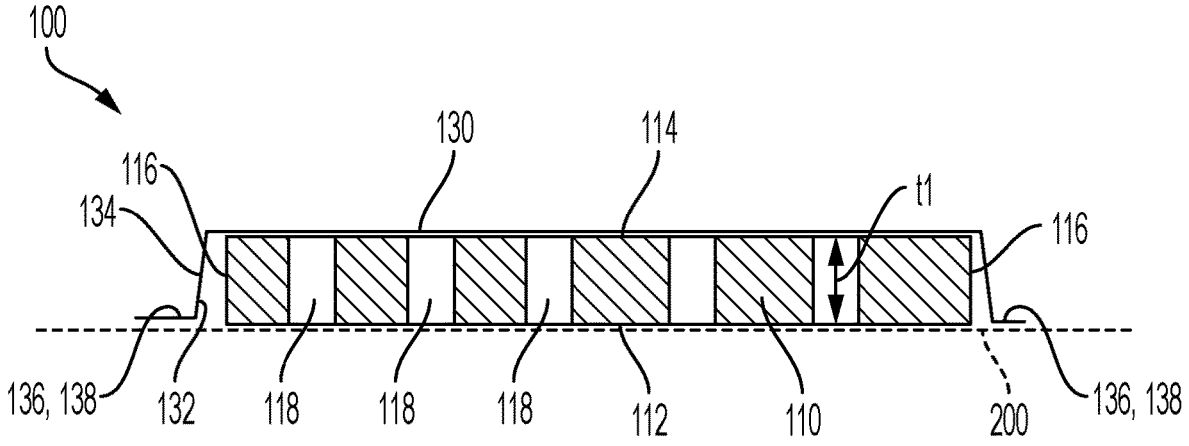
FIG. 2 illustrates a sectional view of the pad of FIG. 1.

As shown in FIGS. 1 and 2, the first pad layer 110 has an inner surface 112, an outer surface 114, a perimeter edge 116, and a thickness t1. (In this context, the term "inner" refers to the body-facing surface that would face the body of the person who is wearing the pad in use, and the term "outer" refers to the surface that would face away from the wearer's body during use.) The first pad layer 110 may be made of an elastomeric material such as, for example, ethylene-vinyl acetate (e.g., EVA) foam, vinyl nitrile foam, vinyl sponge, neoprene sponge, sponge rubber, solid viscoelastic polymers, or the like. The first pad layer 110 may have a Shore durometer (e.g., hardness) value of about 50, about 35, about 30, about 25, or other values to prevent impacts from injuring the wearer. As described below, the first pad layer 110 may have one or more voids 118.

The mesh panel 130 has an inner surface 132, an outer surface 134, and a perimeter edge 136. The mesh panel 130 may be made of a fabric material such as, for example, Spandex (e.g., LYCRA), nylon, polyester, cotton, or the like and/or a combination of these materials. The perimeter edge 136 of the mesh panel 130 may create a surface area having a width that is greater than the width of the surface area created by the perimeter edge 116 of the first pad layer 116. The mesh panel 130 may be sewn to the garment fabric adjacent all perimeter edges 136 thus permanently enclosing the first pad layer 110 adjacent to the garment fabric. Alternatively, the mesh panel 130 may be sewn along all but one perimeter edge 136 forming a pocket matching the shape of the first pad layer 110. The mesh panel 130 serves as a cover that extends beyond and forms a frame 138 along one or more perimeter edges 136 of the pad 110 for fixing the mesh panel 130 to the garment fabric, for example, by sewing.

The impact absorbing pad 100 may be a multi-part component formed by a mesh panel 130 separated from a first pad layer 110 or may be an integral component formed by a mesh panel 130 joined to a first pad layer 110. For example, a portion of the inner surface 132 of the mesh panel 130 may be fixed to a portion of the outer surface 114 of the first pad layer 110. Examples of fixing the two parts together are sewing, gluing (e.g., adhesives), hot welding, or the like. Other methods of forming an integral pad component may be placing a portion of the oversized mesh panel 130 in the bottom of a mold form prior to injecting foam material for the first pad layer 110 thus forming the foam into, through, and around a portion of the mesh holes of the mesh panel 130.

FIG. 2 illustrates a sectional view along cutline 2-2 of the pad 100 of FIG. 1. The first pad layer 110 may be covered by the mesh panel 130. The thickness t1 may be within the range of approximately 8 mm to approximately 13 mm, such as about 10 mm, to provide sufficient protection for the wearer without adding cumbersome weight or volume to the wearer's garment, for example. The voids 118 provide a pathway for moisture to escape and for flexibility in the pad 100.

The first pad layer 110 and mesh panel 130 may have the same color or may have different colors from each other and/or the garment to be attached to. For example, a garment having a first color may have a mesh panel 130 with the same color and a first pad layer 110 with a second color so as to contrast below the mesh panel 130.

Figure 3:
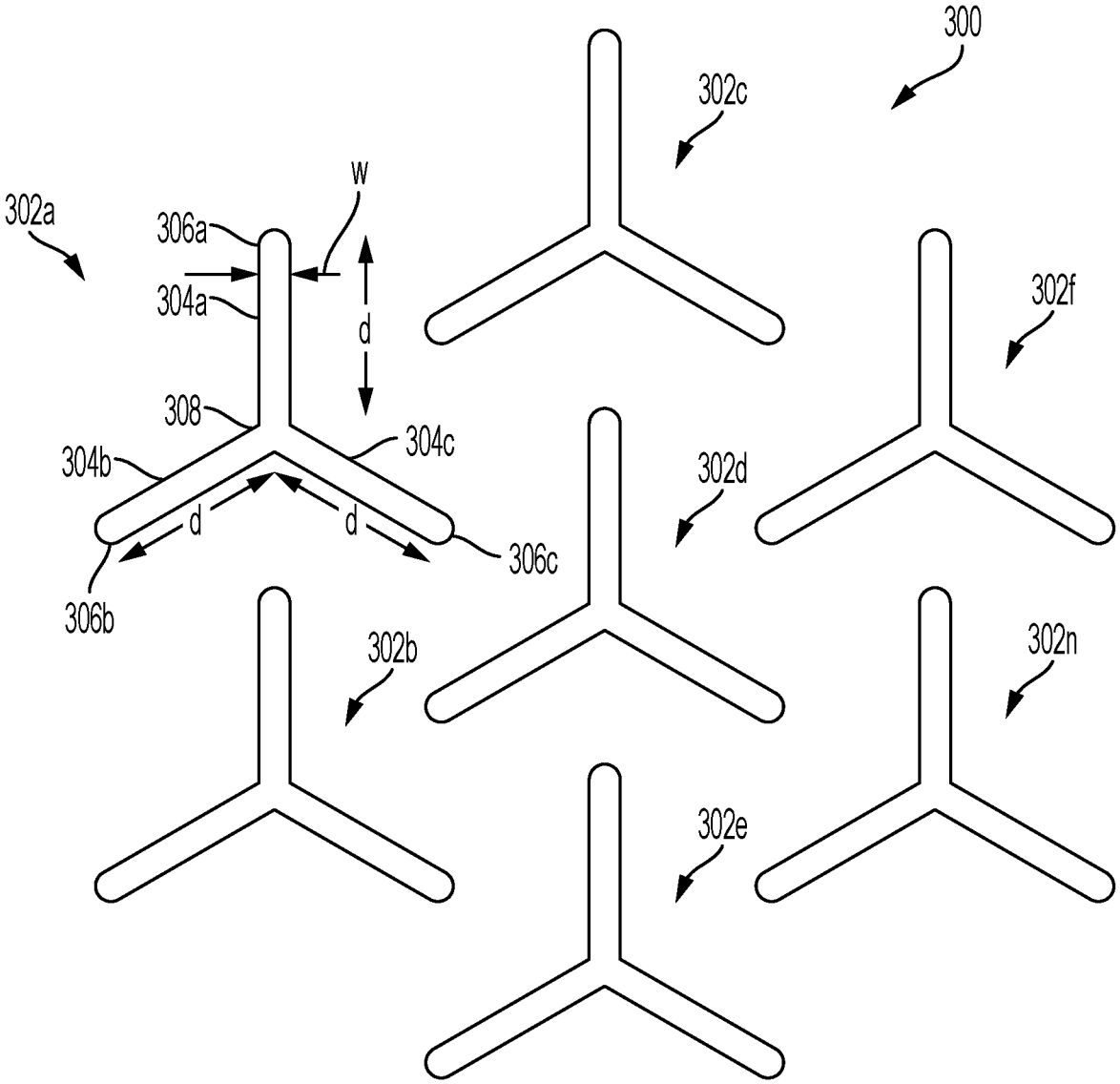
FIG. 3 illustrates an example geometric pattern of voids formed in a pad.

FIG. 3 illustrates an example geometric pattern 300 of voids 302*a* . . . 302*n* (hereinafter 302 unless distinctly one or the other). The voids 302 may be formed by laser cutting, die cutting, extrusion, molding, or the like. Each void 302 has a thickness equal to the thickness of the pad layer in which it is formed and a width w. The width w may be in the range of approximately 2 mm to approximately 5 mm, such as about 3 mm. The pattern 300 may be such that the voids 302 are arranged in aligned columns. For example, as shown in FIG. 3, a first column may have voids 302*a* and 302*b*; a second column may have voids 302*c*, 302*d*, and 302*e*; and a third column may have voids 302*f* and 302*n*. Each column may include more or fewer voids 302, and any pad may have more or fewer columns. Each void 302 may have varying shapes or identical shapes. For example, each void 302 may have a pattern of shapes having three arms 304*a*, 304*b*, 304*c* (e.g., void arms, hereinafter 304 unless distinctly one or the other) each having a distal end 306*a*, 306*b*, 306*c* (hereinafter 306 unless distinctly one or the other) that extends from a central vertex point 308. The three arms 304 may form a tri-arm shape (e.g., Y-shaped). The arms 304 of each void 302 may be equal in length d and may be angled 120 degrees apart. The intersection of the arms 304 of each void 302 occurs at its central vertex 308.

Figure 4:
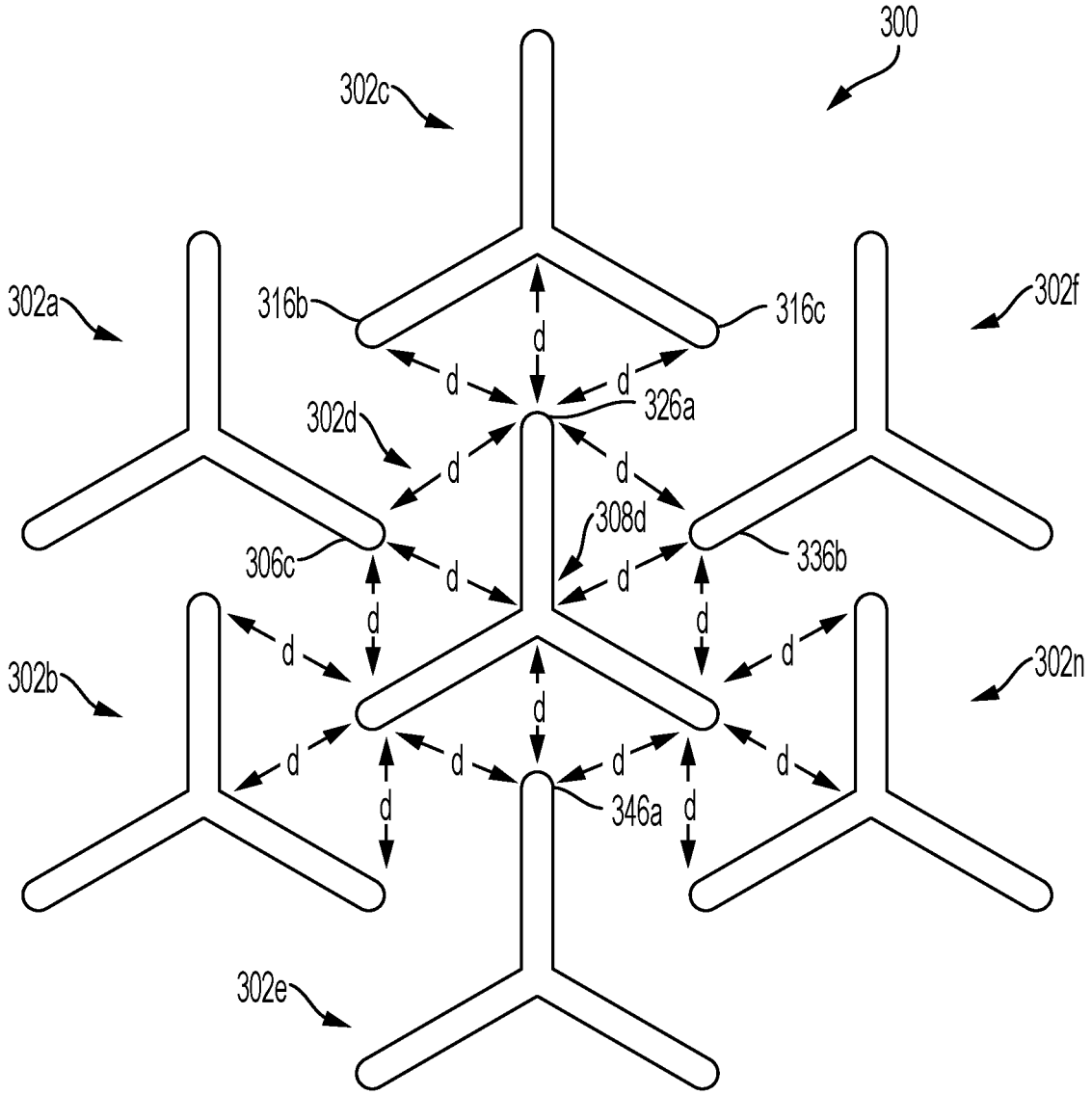
FIG. 4 illustrates a spatial relationship between the voids of FIG. 3.

FIG. 4 illustrates a spatial relationship between the voids 302 of FIG. 3.

The distal ends 306 of each void 302 may be spaced equidistant d from the adjacent distal ends 306 of the closest adjacent void 302. The equidistant spacing d is equal in length to the length d of the arms 304. Referring by way of example to void 302*d* in FIG. 4, the distal end 326*a* of void 302*d* is spaced d from distal end 306*c* of void 302*a*. Distal end 326*a* of void 302*d* also is spaced d from distal ends 316*b* and 316*c* of void 302*c*. This pattern continues for all closest adjacent distal ends 306 in the pattern.

The vertex 308 of each void 302 may be spaced equidistant d from the distal end 306 of the closest adjacent void 302. The equidistant spacing d is also equal in length to the length d of the arms 304 and the equidistant spacing d between adjacent distal ends 306. Referring by way of example to void 302*d* in FIG. 4, the vertex 308*d* of void 302*d* is spaced d from the distal end 306*c* of void 302*a*. Vertex 308*d* of void 302*d* is also spaced d from the distal end 336*b* of void 302*f*, and from the distal end 346*a* of void 302*e*.

Likewise, the vertex 308 of each void 302 may be spaced equidistant d+d from the vertex 308 of each adjacent void 302. The equidistant spacing d+d is equal in length to twice the length d of the arms 304, twice the equidistant spacing d between adjacent distal ends 306; and twice the equidistant spacing d between adjacent distal ends 306 and vertices 308. Referring by way of example to void 302*d* in FIG. 4, the vertex 308*d* of the void 302*d* is spaced d+d from the vertices of all adjacent voids 302*a*, 302*b*, 302*c*, 302*e*, 302*f* and 302*n*.

The distance d may be in the range of approximately 8 mm to approximately 12 mm, such as about 8 mm. All voids 302 may follow this repeating geometric pattern 300 to provide an impact absorbing pad having a flexible form capable of conforming to the wearer's body. The tri-arm shape of the voids 302 provide improved flexure in multiple directions such that a pad may flex in multiple directions more than a pad having no voids or a pad having other shaped voids.

Figure 5:
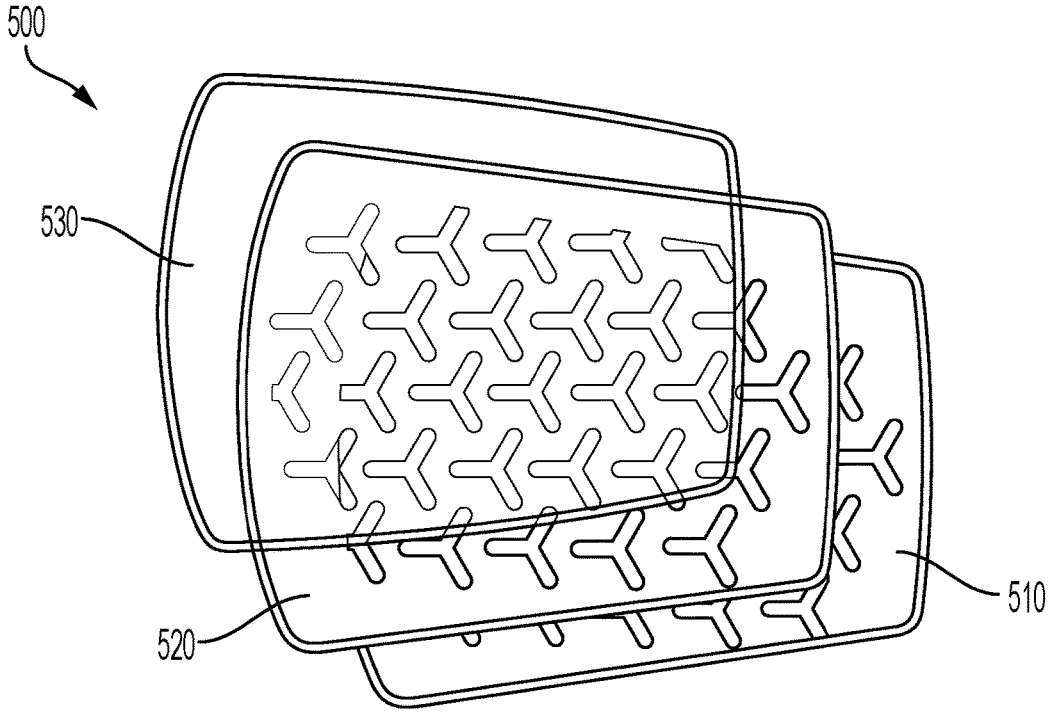
FIG. 5 illustrates an expanded view of another example pad.

FIG. 5 illustrates an expanded view of another example impact absorbing pad 500. The impact absorbing pad 500, as shown in FIG. 5, may be a dual-layer device having a first inner layer of impact absorbing material (e.g. a first pad layer) 510, a second outer layer of impact absorbing material (e.g. a second pad layer) 520, and an oversized mesh panel 530 for covering the first and second pad layers 510, 520 and for attaching to a fabric portion of a garment.

Figure 6A:
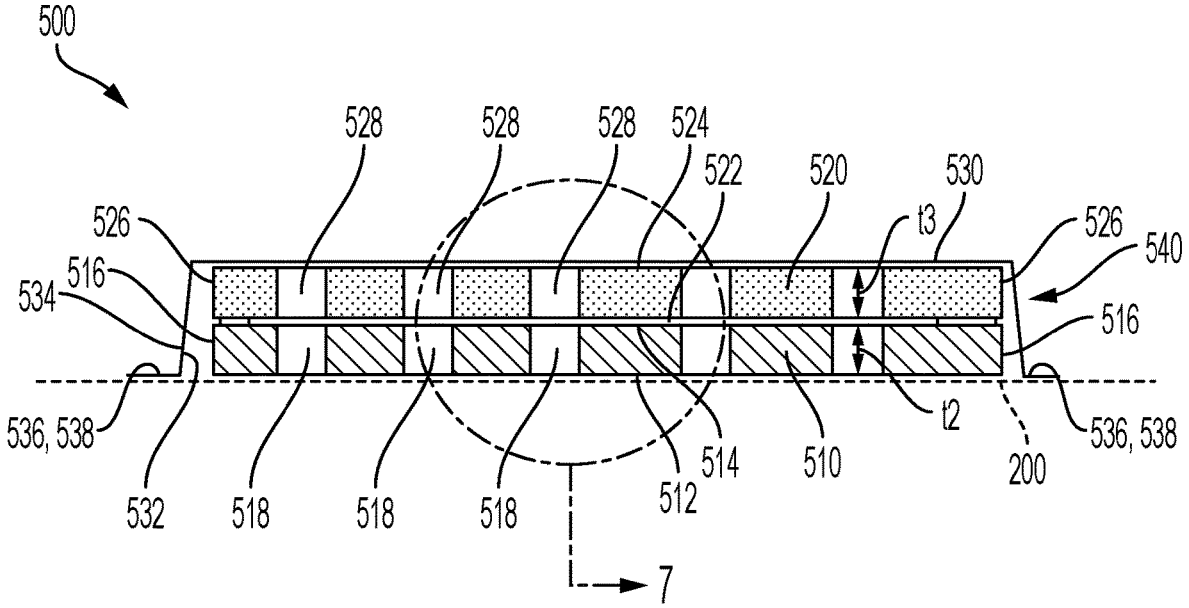
FIG. 6A illustrates a sectional view of an alternate pad, such as that of FIG. 5.
Figure 6B:
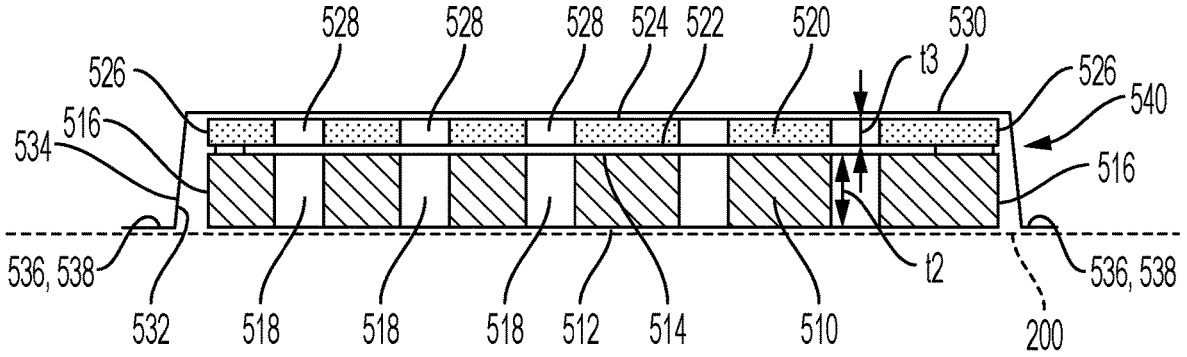
FIG. 6B illustrates a sectional view of a variation of the pad of FIG. 6A.

As shown in FIGS. 6A and 6B, the first pad layer 510 has an inner surface 512, an outer surface 514, a perimeter edge 516, and a thickness t2. The first pad layer 510, when in use, is placed adjacent the wearer's body (e.g., the inner pad layer). The first pad layer 510 may also be made of an elastomeric material as described above in the single-layer embodiment of FIG. 1. For example, the first pad layer 510 may have a foam material having a first density. The first pad layer 510 may have a Shore durometer (e.g., hardness) value of about 35, about 30, about 25, about 20, or other values to prevent impacts from injuring the wearer. As described below, the first pad layer 510 may have one or more voids 518.

The second pad layer 520 has an inner surface 522, an outer surface 524, a perimeter edge 526, and a thickness t3. The second pad layer 520, when in use, is placed on the outer region of the pad 500 (e.g., the outer pad layer). The second pad layer 520 may also be made of an elastomeric material as described above. For example, the second pad layer 520 may have a foam material having a second density different from the first density of the first pad layer 510 foam material (i.e., a pad 500 having a dual-density foam material). The second pad layer 520 may have a Shore durometer (e.g., hardness) value of about 45, about 40, about 35, or other values to further prevent impacts from injuring the wearer. The Shore durometer value of the second pad layer 520 may be the same as the Shore durometer value of the first pad 510, or it may be different. For example, the Shore durometer value of the second pad layer 520 may be about two times (2×) greater, about one and three quarter times (1.75×) greater, about one and half times (1.5×) greater, or other multiples of times greater than the Shore durometer value of the first pad 510 so as to provide a more rigid outer layer (i.e., the second pad layer 520) to provide more shock absorption and/or reduce deformation caused by objects that may impact the user and to provide a softer inner panel (i.e., the first pad layer 510) for a more conforming deformation against the user's body. As described below, the second pad layer 520 may also have one or more voids 528.

The mesh panel 530 has an inner surface 532, an outer surface 534, and a perimeter edge 536. The mesh panel 530 may also be made of a fabric material as described above. The perimeter edge 536 of the mesh panel 530 may create a surface area greater than the surface area created by the perimeter edges 516, 526 of the first pad layer 510 and second pad layer 520. The mesh panel 530 may also be sewn to the garment fabric as described above. The mesh panel 530 may also include a frame 538 along one or more perimeter edges 536 for fixing the mesh panel 530 to the garment fabric, for example, by sewing.

The impact absorbing pad 500 may be a multi-part component formed by a mesh panel 530 separated from a second pad layer 520 and a first pad layer 510 or may be an integral component formed by a mesh panel 530 joined to a second pad layer 520 which is likewise joined to a first pad layer 510 in a stacked layer design. For example, a portion of the inner surface 532 of the mesh panel 530 may be fixed to a portion of the outer surface 524 of the second pad layer 520 as described above. Likewise, a portion of the inner surface 522 of the second pad layer 520 may be fixed to a portion of the outer surface 514 of the first pad layer 510. For example, an adhesive layer 540 may be applied between a portion of the inner surface 522 of the second pad layer 520 and a portion of the outer surface 514 of the first pad layer 510.

The first pad layer 510, second pad layer 520, and mesh panel 530 may have the same color or may have different colors from each other and/or the garment to be attached to. For example, a garment having a first color may have a second pad layer 520 and mesh panel 530 with the same color and a first pad layer 510 with a second color so as to provide a color contrast. This variability would provide a selection of pads 500 having various colors to match the user's team colors.

Thus, FIG. 6A illustrates a sectional view of a dual-layer pad 500. The first pad layer 510 and second pad layer 520 may be covered by the mesh panel 530. An adhesive layer 540 may fix the first pad layer 510 and second pad layer 520 together as described above. The thicknesses t2 and t3, for example, may be equal and within the range of 4 mm to 7 mm, such as 5.5 mm, to provide sufficient rigidity to the outer pad layer (second pad layer 520) and softness to the inner pad layer (first pad layer 510). The voids 518, 528 provide a pathway for moisture to escape and for flexibility in the pad 500.

As shown in FIGS. 5, 6A, and 6B, the voids of each pad layer may be positioned to have shapes that match, and they also may be positioned such that when the pad layers are positioned against each other, the corresponding voids of each pad layer will be positioned over each other and form a larger void that extends through both layers. The surface area of each void may be the same, or the voids of one pad layer (such as the outer pad layer) may have a greater surface area than the voids of the other pad layer.

FIG. 6B illustrates a sectional view of an alternate dual-layer pad 500' similar to FIG. 6A. The relative thicknesses t2 and t3 of the first pad layer 510 and second pad layer 520 may be the same, as shown in FIG. 6A or they may have varying thicknesses t2 and t3 as shown in FIG. 6B. The thickness t2 of the first pad layer 510, for example, may be within the range of 5 mm to 9 mm, such as 8 mm, and the thickness t3 of the second pad layer 520, for example, may be within the range of 3 mm to 6 mm, such as 3 mm, to provide sufficient rigidity to the outer pad layer (second pad layer 520) and softness to the inner pad layer (first pad layer 510). For example, as shown in FIG. 6B, the thickness t2 of the first pad layer 510 may be greater than the thickness t3 of the second pad layer 520. The varying thicknesses t2 and t3 of the pad layers 510, 520 may be tuned for different needs, such as a thicker outer layer (i.e., the second pad layer 520) having a higher Shore durometer value (i.e., more rigid) for sports having impact objects with sharp edges, such as when a hockey puck hits a hockey player, compared to a thicker inner layer (i.e., the first pad layer 510) having a lower Shore durometer value (i.e., softer) for sports having impact objects without sharp edges but large impact forces, such as when a football player is tackled by another football player or is tackled to the ground.

Figure 7A:
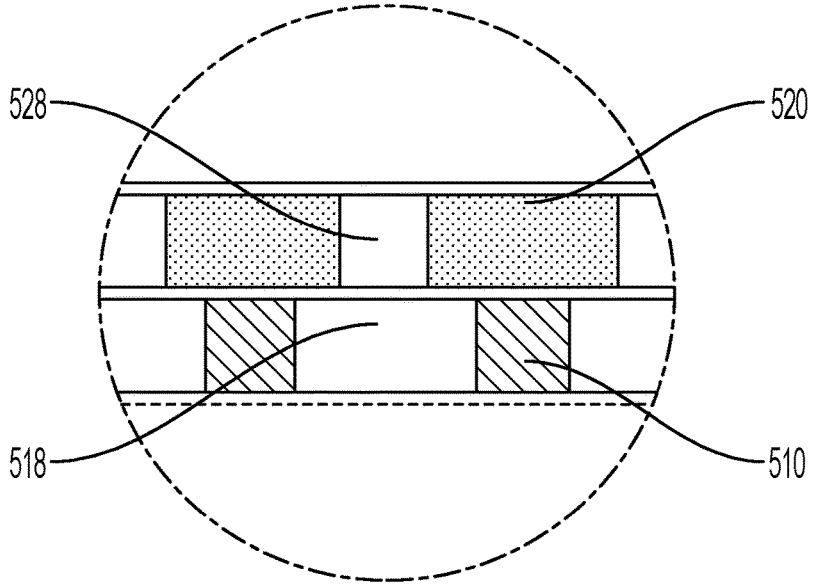
FIGS. 7A-7C illustrate a detailed view of a pad similar to that of FIG. 6A having variations of pad layers with voids.
Figure 7B:
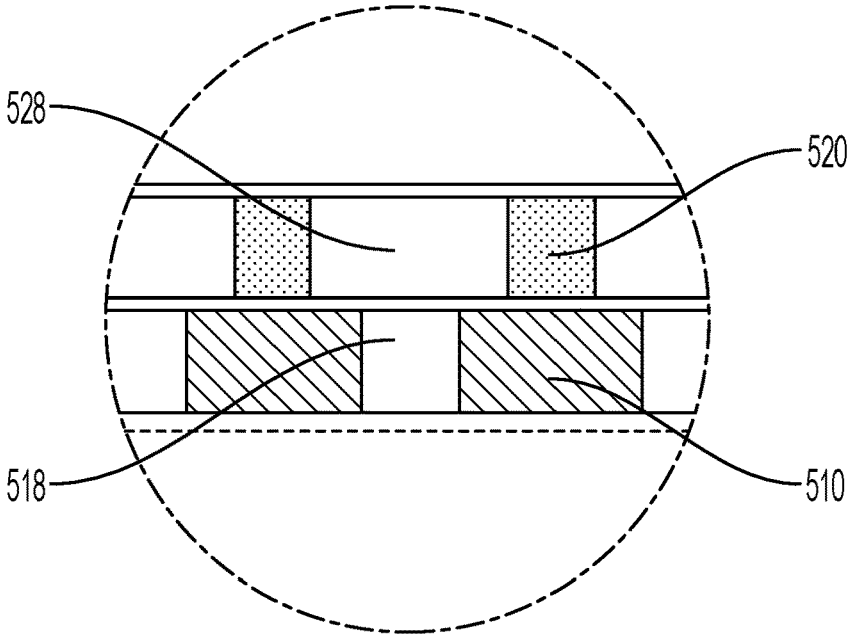
Figure 7C:
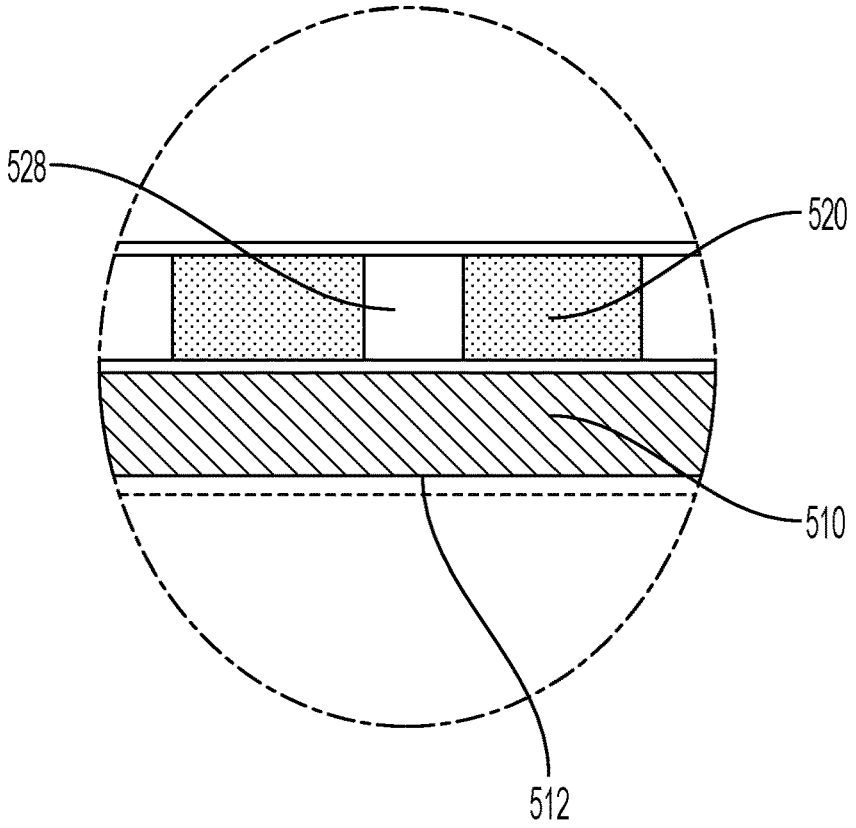

For a dual-layer pad, the voids of the first pad layer and the voids of the second pad layer may have the same shape, size, placement, and orientation so as to create equal voids through the pad layers. Alternatively, the voids may have varying shapes, sizes, placements, and/or orientations. FIGS. 7A-7C illustrate a detailed view of a pad similar to the pad 500 of FIG. 6A having variations of pad layers with voids. For example, as shown in FIG. 7A, the voids 518 on the first pad layer 510 may have the same shape, placement, and orientation as the voids 528 on the second pad layer 520 but with a larger size to allow more moisture to be wicked away during strenuous activities. The larger size may result from the voids of the first layer having a larger surface area than the voids of the second layer, which could occur for example if the arms of the tri-arm-shaped voids in the first have a wider width than those of the second layer. Likewise, as shown in FIG. 7B, the voids 518 on the first pad layer 510 may have the same shape, placement, and orientation as the voids 528 on the second pad layer 520 but with a smaller size to provide a decorative color contrast between the voids 518, 528 and or descriptive design to the pads 500. Alternatively for a dual-layer pad 500, the voids 518, 528 may be on only one of the pad layers 510, 520 such that, as shown in FIG. 7C, for example, a first pad layer 510 having no voids 518 provides a flush inner surface 512 while the second pad layer 520 includes voids 528 to provide more flexure of the pad 500.

Figure 8:
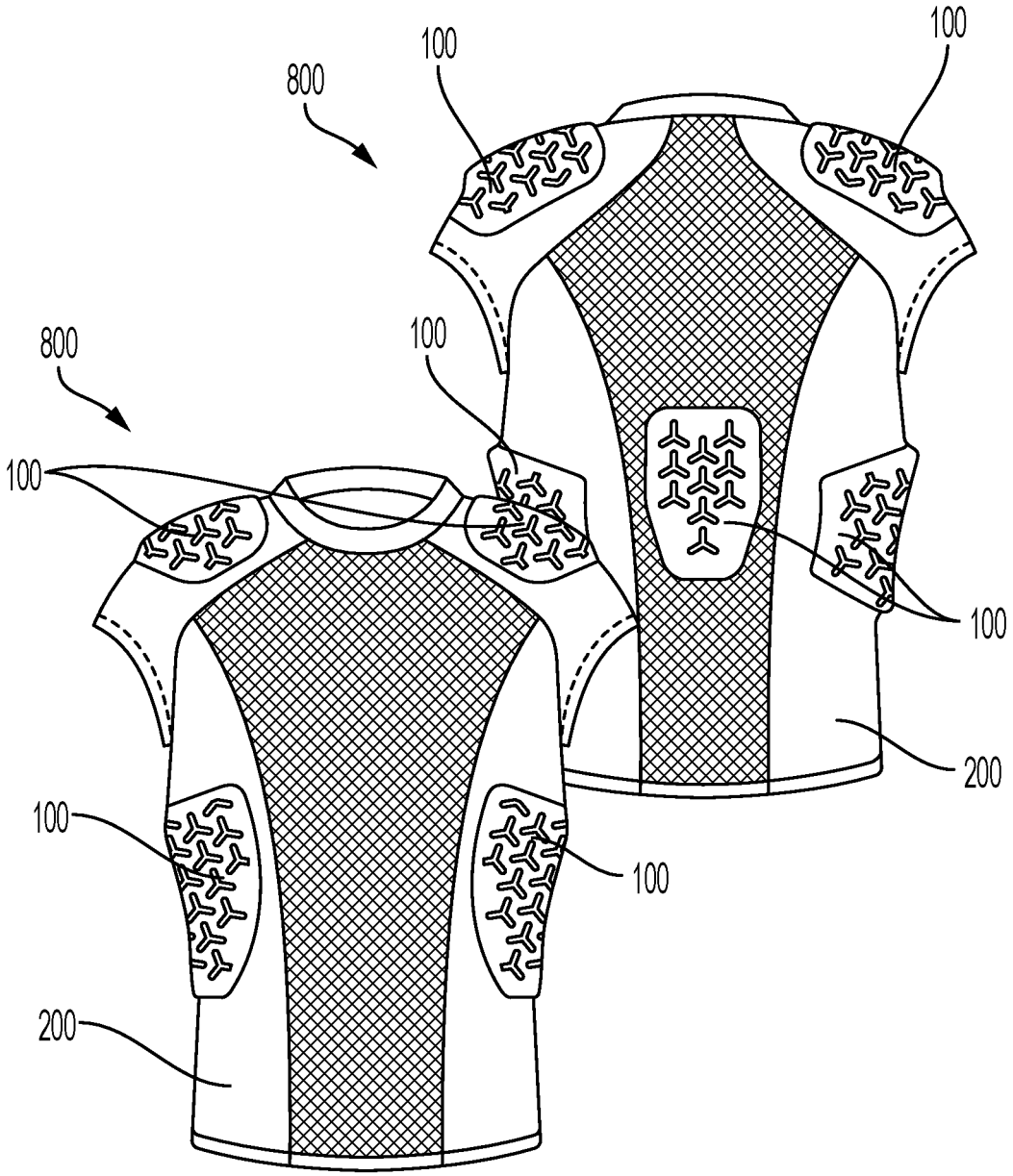
FIG. 8 illustrates a front and back view of an example shirt garment employing one or more pads.
Figure 9:
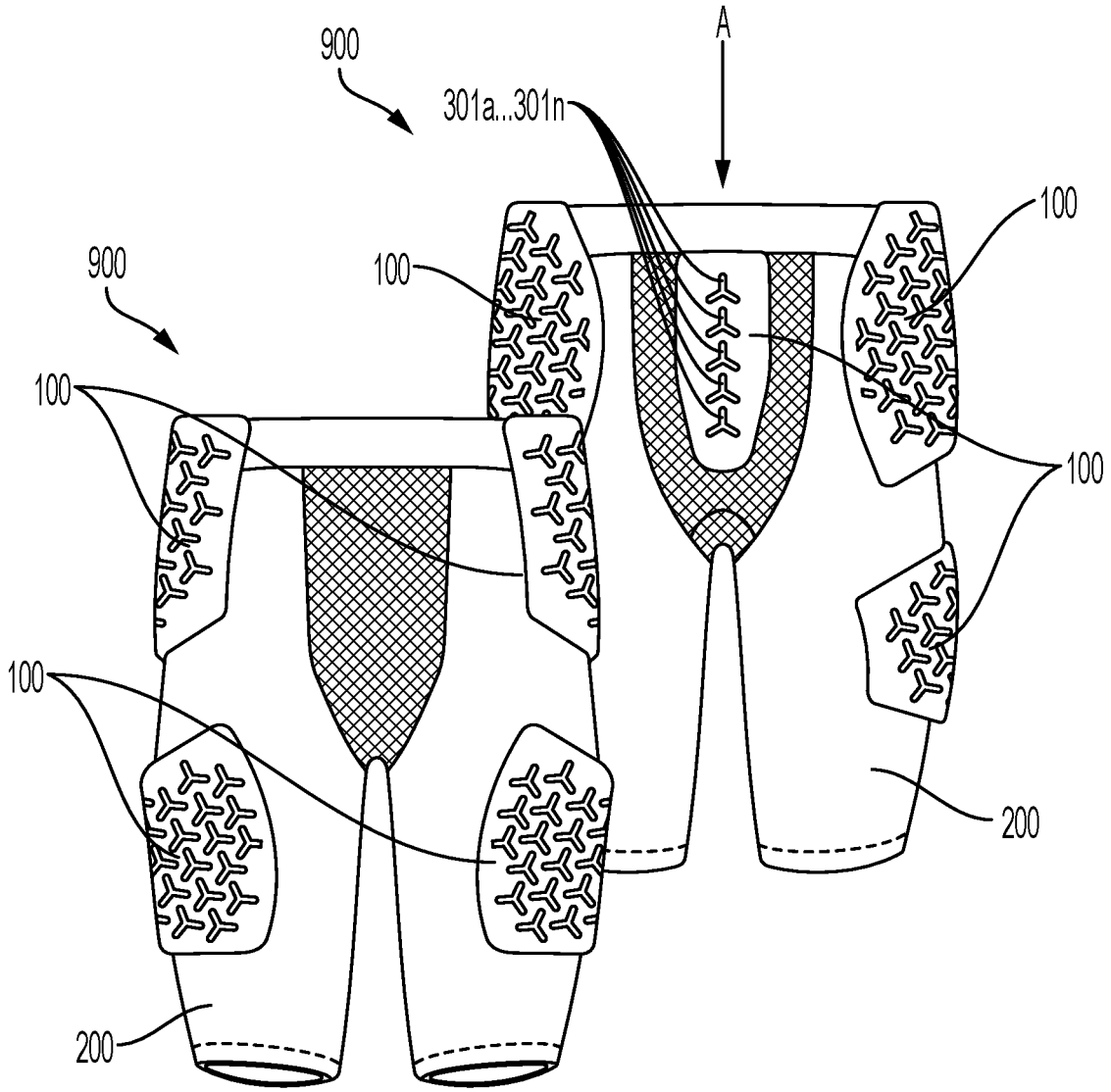
FIG. 9 illustrates a front and back view of an example pants garment employing one or more pads.

FIG. 8 illustrates a front and back view of a padded garment, for example, a shirt garment 800 employing one or more pads 100. FIG. 9 illustrates a front and back view of an example pants garment 900 employing one or more pads 100. Pads 100 may be symmetrical or asymmetrical. Pads 100 may have a variety of shapes, such as round, triangular, square, rectangular, pentagon, hexagon, or the like. Pads 100 may also have curved edges. Pads 100 may have voids in a plurality of columns or a single column arranged in a pattern as described above. Alternatively, for example, as shown in FIG. 9, for protection of a wearer's tailbone, a pad 100 may have a single column of voids.

The features and functions described above, as well as alternatives, may be combined into many other different systems or applications. Various alternatives, modifications, variations or improvements may be made by those skilled in the art, each of which is also intended to be encompassed by the disclosed embodiments.

The invention claimed is:

1. A garment product comprising:

a garment having a fabric;

a cover coupled to a portion of the fabric of the garment; and a pad disposed between the fabric of the garment and the cover, the pad including:

an inner layer having a first inner surface proximate the fabric of the garment, a first outer surface, and a first thickness, the inner layer comprising a first foam material having a first density, the inner layer defining a first plurality of voids, each of the first plurality of voids having a first central vertex and a first plurality of void arms extending radially outward from the first central vertex, each of the first plurality of void arms having a first width; and an outer layer having a second inner surface coupled to the first outer surface of the inner layer, a second outer surface, and a second thickness, the outer layer comprising a second foam material having a second density different than the first density of the inner layer, the outer layer defining a second plurality of voids in alignment with the first plurality of voids of the inner layer, each of the second plurality of voids having a second central vertex and a second plurality of void arms extending radially outward from the second central vertex, each of the second plurality of void arms having a second width that is greater than the first width such that portions of the first outer surface of the inner layer are visible through the second plurality of voids of the outer layer;

wherein sidewalls of the first plurality of voids and the second plurality of voids are substantially straight such that the first width and the second width are substantially uniform through the first thickness of the inner layer and the second thickness of the outer layer, respectively.

2. The garment product of claim 1, wherein the first width is between about two millimeters and about three millimeters, and wherein the second width is between about three millimeters and about five millimeters.

3. The garment product of claim 1, wherein the second thickness is between about three millimeters and six millimeters.

4. The garment product of claim 1, wherein each of the first plurality of void arms has a first arm length, and wherein a distance between the first central vertex of adjacent voids of the first plurality of voids is about twice the first arm length.

5. The garment product of claim 4, wherein the first arm length is between about eight millimeters and about twelve millimeters.

6. The garment product of claim 1, wherein the inner layer has a first color and the outer layer has a second color that is different than the first color.

7. The garment product of claim 6, wherein the fabric has the second color and the cover has the second color.

8. The garment product of claim 1, wherein the cover has a mesh structure.

9. The garment product of claim 1, wherein a perimeter edge of the cover extends beyond the pad, wherein at least a portion of the perimeter edge is secured to the fabric of the garment.

10. The garment product of claim 9, wherein an entirety of the perimeter edge of the cover is secured to the fabric of the garment, thereby enclosing the pad between the fabric of the garment and the cover.

11. The garment product of claim 1, wherein the cover is a first cover, the pad is a first pad, and the portion of the fabric of the garment is a first portion of the fabric, further comprising:

a second cover coupled to a second portion of the fabric of the garment; and a second pad disposed between the fabric of the garment and the second cover;

wherein the second pad is different than the first pad.

12. The garment product of claim 11, wherein the second pad includes the inner layer and the outer layer, wherein the first plurality of voids and the second plurality of voids of the first pad are arranged in a plurality of offset columns, and wherein the first plurality of voids and the second plurality of voids of the second pad are arranged in a single column.

13. The garment product of claim 11, wherein the second pad has a single layer.

14. The garment product of claim 1, wherein the second thickness of the outer layer is greater than the first thickness of the inner layer.

15. A garment product comprising:

a garment having a fabric and a cover coupled to a portion of the fabric and having a mesh structure;

an impact absorbing pad disposed between the fabric of the garment and the cover, the impact absorbing pad including:

a first layer having a first body-facing surface positioned adjacent the garment and a first outer surface opposite the first body-facing surface, the first layer comprising a first foam having a first density, the first layer defining a first plurality of voids that extend through the first layer at a first plurality of positions; and a second layer having a second body-facing surface positioned adjacent the first outer surface of the first layer and a second outer surface opposite the second body-facing surface, the second layer comprising a second foam having a second density that is different than the first density, and the second layer defining a second plurality of voids that extend through the second layer at a second plurality of positions;

wherein the first plurality of positions of the first plurality of voids of the first layer correspond with the second plurality of positions of the second plurality of voids of the second layer such that the first plurality of voids and the second plurality of voids are aligned;

wherein the first plurality of voids have a first size and the second plurality of voids have a second size that is greater than the first size;

wherein the first layer has a first color;

wherein the second layer, the fabric, and the cover have a second color that is different than the first color; and wherein portions of the first outer surface of the first layer are visible through the second plurality of voids of the second layer.

16. A garment product comprising:

a first impact absorbing pad; and a second impact absorbing pad, each of the first impact absorbing pad and the second impact absorbing pad consisting of:

a first layer having a first body-facing surface configured to be positioned adjacent a garment and a first outer surface opposite the first body-facing surface, the first layer comprising a first foam having a first density, the first layer defining a first plurality of voids that extend through the first layer at a first plurality of positions; and a second layer having a second body-facing surface positioned adjacent the first outer surface of the first layer and a second outer surface opposite the second body-facing surface, the second layer comprising a second foam having a second density that is different than the first density, and the second layer defining a second plurality of voids that extend through the second layer at a second plurality of positions;

wherein portions of the first outer surface of the first layer are visible through the second plurality of voids of the second layer;

wherein the first plurality of positions of the first plurality of voids of the first layer correspond with the second plurality of positions of the second plurality of voids of the second layer such that the first plurality of voids and the second plurality of voids are aligned; and wherein the first plurality of voids have a first size and the second plurality of voids have a second size that is greater than the first size;

wherein the first plurality of voids and the second plurality of voids of the first impact absorbing pad are arranged in a plurality of columns; and wherein the first plurality of voids and the second plurality of voids of the second impact absorbing pad are arranged in only a single column.

17. A garment product comprising:

a garment having a fabric;

a first cover coupled to a first portion of the fabric of the garment;

a second cover coupled to a second portion of the fabric of the garment;

a first pad disposed between the fabric of the garment and the first cover; and a second pad disposed between the fabric of the garment and the second cover;

wherein:

the first cover and the second cover have a mesh structure;

each of the first pad and the second pad includes an inner layer and an outer layer;

the inner layer has a first color;

the fabric of the garment, the outer layer, the first cover, and the second cover have a second color that is different than the first color;

the inner layer defines a first plurality of voids having a first size;

the outer layer (a) defines a second plurality of voids aligned with the first plurality of voids and (b) has a second size greater than the first size such that portions of an outermost surface of the inner layer are visible through the second plurality of voids;

the first plurality of voids and the second plurality of voids of the first pad are arranged in a plurality of columns; and the first plurality of voids and the second plurality of voids of the second pad are arranged in a single column.

* * * * *